US012303013B1

(12) United States Patent
Cao

(10) Patent No.: US 12,303,013 B1
(45) Date of Patent: May 20, 2025

(54) CUP SLEEVE WITH HIGH APPLICABILITY

(71) Applicant: Xixian Cao, Changsha (CN)

(72) Inventor: Xixian Cao, Changsha (CN)

(73) Assignee: Changsha Hongda Network Technology Co., LTD, Changsha (CN)

( * ) Notice: Subject to any disclaimer, the term of this patent is extended or adjusted under 35 U.S.C. 154(b) by 0 days.

(21) Appl. No.: 18/747,939

(22) Filed: Jun. 19, 2024

(30) Foreign Application Priority Data

Jan. 12, 2024 (CN) ..... 202420083617.3

(51) Int. Cl.
*A45F 3/02* (2006.01)
*A45F 3/12* (2006.01)
*A45F 5/00* (2006.01)

(52) U.S. Cl.
CPC ..... *A45F 3/02* (2013.01); *A45F 3/12* (2013.01); *A45F 5/1583* (2025.01)

(58) Field of Classification Search
CPC ..... A45F 2200/0583; A45F 2005/006; A45F 2003/002; A45F 3/02; A47G 23/02; A47G 23/0216; A47G 23/0266; A47G 2023/0291; B65D 2313/02; B65D 81/3876; B65D 81/3888
See application file for complete search history.

(56) References Cited

U.S. PATENT DOCUMENTS 5,007,566 A * 4/1991 Fick ..... B62J 11/04 224/438
9,307,854 B2 * 4/2016 Myers ..... B65D 25/22
11,753,209 B1 * 9/2023 Parry ..... B65D 23/14 215/395
11,805,929 B2 * 11/2023 Nelson ..... A47G 23/0266
2008/0047986 A1 * 2/2008 Will ..... A45F 5/02 224/148.3
2021/0052055 A1 * 2/2021 Arias ..... A45C 13/02

* cited by examiner

*Primary Examiner* — Adam J Waggenspack

(57) ABSTRACT

Provided is a cup sleeve with high applicability, including a cylindrical cover having an opening at one end. A side wall of the cylindrical cover is provided with a notch, a first connecting piece and a second connecting piece are respectively arranged on two sides of the notch, and one end of the second connecting piece facing the first connecting piece is detachably connected to the first connecting piece. When the first connecting piece and the second connecting piece are connected, the notch can be partially exposed. When a cup with a handle is located in the cup sleeve, the handle of the cup can extend out of the exposed notch. In this way, the cup with the handle can be accommodated appropriately. When the cup sleeve is used to accommodate a cup without a handle, the cup can be directly inserted from the opening of the cylindrical cover.

11 Claims, 2 Drawing Sheets

CUP SLEEVE WITH HIGH APPLICABILITY

CROSS REFERENCE TO RELATED APPLICATION

This application claims priority benefit of Chinese patent Application No. 202420083617.3, filed on Jan. 12, 2024, and the entire contents of which are incorporated herein by reference.

TECHNICAL FIELD

The present disclosure relates to the technical field of cup sleeves, and in particular to a cup sleeve with high applicability.

BACKGROUND

In the existing design, a cup sleeve only can accommodate a cup without a handle, and is difficult to be suitable for a cup with a handle. Therefore, it is necessary to provide a cup sleeve with high applicability, which is suitable for the cup with the handle, and also suitable for the cup without the handle.

SUMMARY

The present disclosure provides a cup sleeve with high applicability, which can improve the applicability of the cup sleeve.

The technical solution of the present disclosure is: the present disclosure provides a cup sleeve with high applicability, including a cylindrical cover having an opening at one end, where a side wall of the cylindrical cover is provided with a notch, a first connecting piece and a second connecting piece are respectively arranged on two sides of the notch, one end of the second connecting piece facing the first connecting piece is detachably connected to the first connecting piece, and the notch can be partially exposed when the first connecting piece and the second connecting piece are connected.

Further, two ends of the notch are respectively a first end part and a second end part, the first end part is close to the opening of the cylindrical cover relative to the second end part, the first end part extends to the opening of the cylindrical cover, and a first groove is formed between the first end part and the connected first connecting piece and second connecting piece when the first connecting piece and the second connecting piece are connected.

Further, a second groove is formed between the second end part and the connected first connecting piece and second connecting piece when the first connecting piece and the second connecting piece are connected.

Further, the first connecting piece is set as a hoop surface of a hook-and-hoop fastener, and the second connecting piece is set as a hook surface of the hook-and-hoop fastener.

Further, the side wall of the cylindrical cover is further provided with two connecting rings, the cup sleeve with high applicability further includes a strap, and two ends of the strap are respectively connected to the two connecting rings.

Further, first latch fasteners are arranged at two ends of the strap, and the two first latch fasteners are respectively connected to the two connecting rings.

Further, second latch fasteners are connected between the first latch fasteners and the connecting rings.

Further, the side wall of the cylindrical cover is further provided with a lobster clasp, the lobster clasp is used to be connected to a knapsack or other belongings.

Further, the side wall of the cylindrical cover is further provided with a first pocket, the first pocket and the notch are arranged oppositely, and a first zipper is arranged at an opening of the first pocket.

Further, a second pocket is arranged on a surface of the first pocket, and a second zipper is arranged at an opening of the second pocket.

Compared with the prior art, the present disclosure has the following beneficial effects: the side wall of the cylindrical cover is provided with the notch, the first connecting piece and the second connecting piece are respectively arranged on two sides of the notch, and one end of the second connecting piece facing the first connecting piece is detachably connected to the first connecting piece. When the first connecting piece and the second connecting piece are connected, the notch can be partially exposed. When a cup with a handle is located in the cup sleeve, the handle of the cup can extend out of the exposed notch. In this way, the cup with the handle can be accommodated appropriately. When the cup sleeve is used to accommodate a cup without a handle, the cup can be directly inserted from the opening of the cylindrical cover. Therefore, the cup sleeve with high applicability can accommodate the cup with the handle, and also can accommodate the cup without the handle, so that the applicability of the cup sleeve can be improved.

BRIEF DESCRIPTION OF DRAWINGS

To describe the embodiments of the present disclosure or the technical solutions in the prior art more clearly, the accompanying drawings required to be used in the embodiments are briefly introduced below, and the drawings described below are only the corresponding drawings of some embodiments of the present disclosure.

Figure 1:
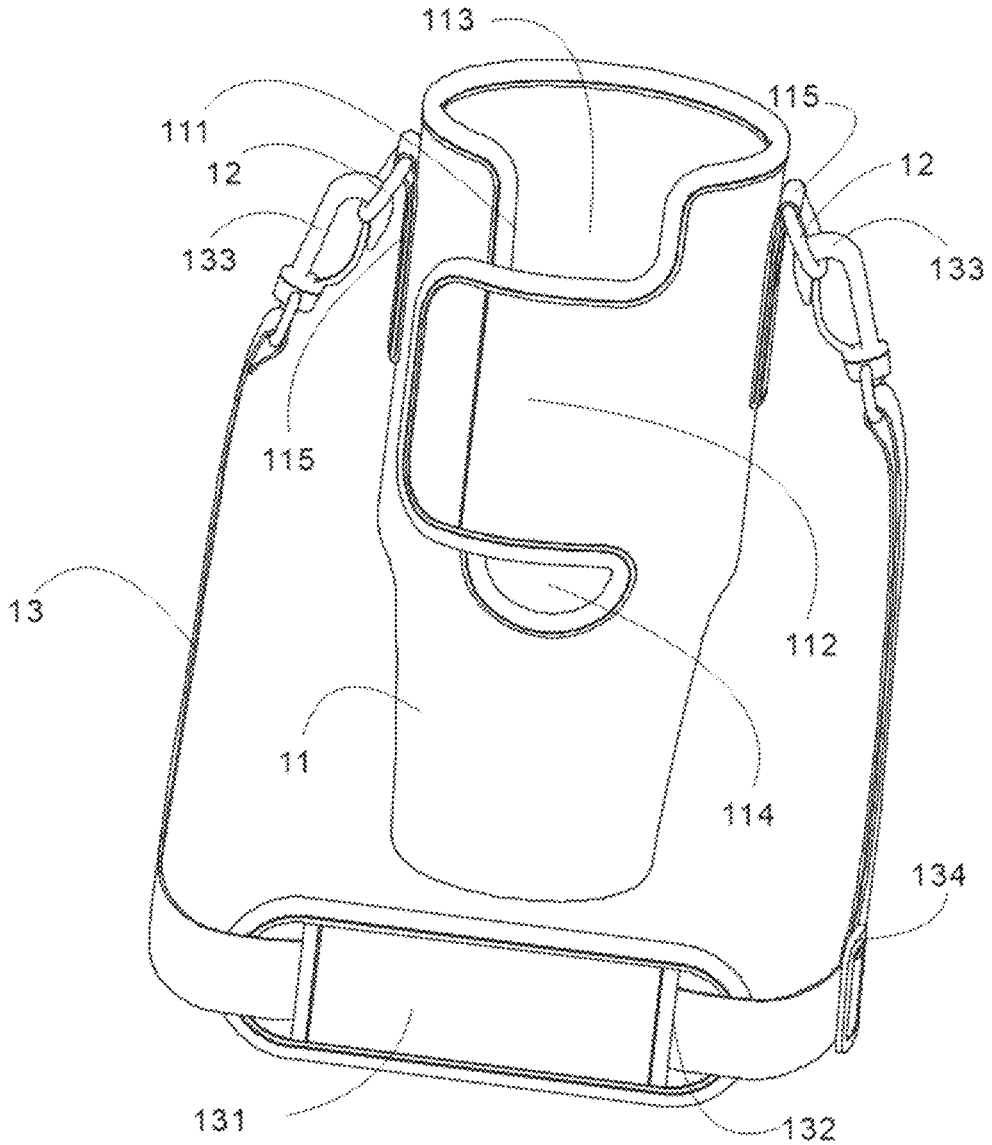
FIG. 1 is a structural schematic diagram of a cup sleeve with high applicability according to a preferred embodiment of the present disclosure.

In the drawings, 11. cylindrical cover; 12. connecting ring; 13. strap; 14. lobster clasp; 15. first pocket; 16. second pocket;

111. notch; 112. second connecting piece; 113. first groove; 114. second groove; 115. first fastening tape; 131. shoulder pad; 132. connecting groove; 133. first latch fastener; 134. adjusting buckle; 141. second fastening tape; 151. first zipper; 161. second zipper.

DETAILED DESCRIPTION OF THE EMBODIMENTS

The technical solutions in the embodiments of the present disclosure are described clearly and completely with reference to the accompanying drawings in the embodiments of the present disclosure. Apparently, the described embodiments are merely a part rather than all of the embodiments of the present disclosure. All other embodiments obtained by those skilled in the art based on the embodiments of the present disclosure without creative efforts shall fall within the protection scope of the present disclosure.

Directional words mentioned in the present disclosure, such as “side”, are only referring to the orientation of the drawings. The directional words used are for describing and understanding the present disclosure, but not for limiting the present disclosure.

The words "first", "second" and the like in the terms of the present disclosure are only used for description, cannot be understood as indicating or implying relative importance, and are not used as a limitation on the order.

In the present disclosure, unless otherwise specified and limited, the term "connection" should be understood in a broad sense, for example, it may be fixed connection, or may be detachable connection, or integrated; it may be mechanical connection or may be electric connection; and it may be direction connection, may be indirect connection through an intermediate medium, or may be internal communication of two components or an interaction relationship between two components. For those of ordinary skill in the art, the specific meaning of the above-mentioned terms in the present disclosure can be construed according to specific cases.

Figure 2:
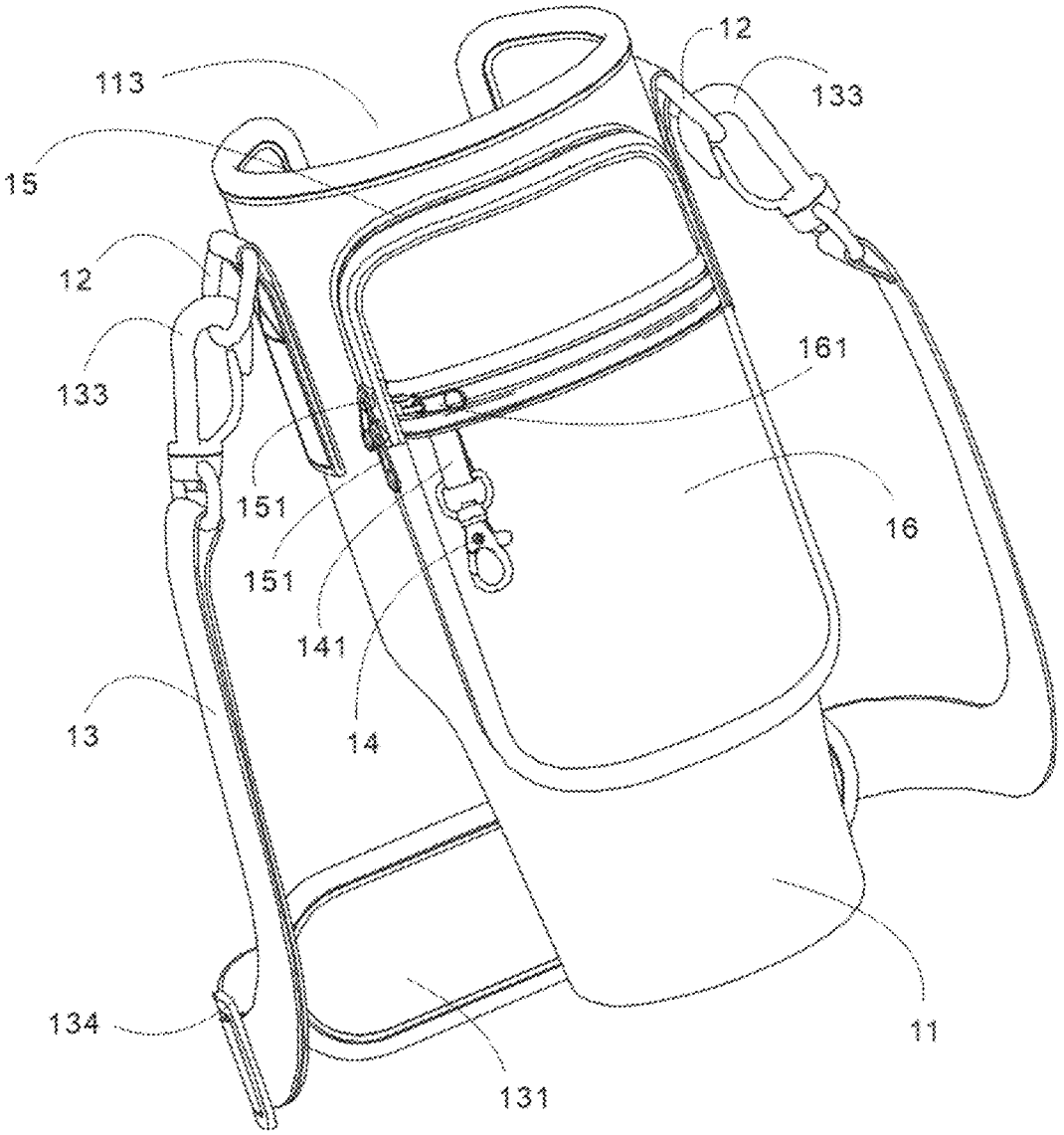
FIG. 2 is a structural schematic diagram of the cup sleeve with high applicability provided in FIG. 1 from another perspective.

Referring to FIG. 1 and FIG. 2, the preferred embodiment of the present disclosure provides a cup sleeve with high applicability, including a cylindrical cover 11 having an opening at one end, where a side wall of the cylindrical cover is provided with a notch 111, a first connecting piece (not shown in the figure) and a second connecting piece 112 are respectively arranged on two sides of the notch 111, one end of the second connecting piece 112 facing the first connecting piece is detachably connected to the first connecting piece, and the notch 111 can be partially exposed when the first connecting piece and the second connecting piece 112 are connected. The side wall of the cylindrical cover 11 is provided with the notch 111, the first connecting piece and the second connecting piece 112 are respectively arranged on two sides of the notch 111, and one end of the second connecting piece 112 facing the first connecting piece is detachably connected to the first connecting piece. When the first connecting piece and the second connecting piece 112 are connected, the notch 111 can be partially exposed. When a cup with a handle is located in the cup sleeve, the handle of the cup can extend out of the exposed notch 111. In this way, the cup with the handle can be accommodated appropriately. When the cup sleeve is used to accommodate a cup without a handle, the cup can be directly inserted from the opening of the cylindrical cover 11. Therefore, the cup sleeve with high applicability can accommodate the cup with the handle, and also can accommodate the cup without the handle, so that the applicability of the cup sleeve can be improved.

When the cup with the handle is put into the cup sleeve, the first connecting piece and the second connecting piece 112 are disassembled first, and then the cup is put into the cylindrical cover 11, so that the handle is extended out from the notch 111, and then the first connecting piece and the second connecting piece 112 are connected.

When the cup without the handle is put into the cup sleeve, the first connecting piece and the second connecting piece 112 are disassembled first, so that the opening of the cylindrical cover 11 becomes larger, and the cup can be put in the cylindrical cover conveniently. After the cup is put in the cylindrical cover, the first connecting piece and the second connecting piece 112 are connected.

Two ends of the notch 111 are respectively a first end part and a second end part, the first end part is close to the opening of the cylindrical cover 11 relative to the second end part, the first end part extends to the opening of the cylindrical cover 11, and a first groove 113 is formed between the first end part and the connected first connecting piece and second connecting piece 112 when the first connecting piece and the second connecting piece 112 are connected. This structure is suitable for a cup, in which one end of the handle is connected to the cup wall and the other end of the handle and the cup wall are arranged at intervals. When the cup is put into the cup sleeve, one side of the cup with the handle is aligned with the first groove 113. After the cup is completely put into the cup sleeve, the joint of the handle and the cup wall is located in the first groove 113. At this time, the cup can be put in the cup sleeve conveniently without disassembling the first connecting piece and the second connecting piece 112, thereby facilitating the use.

When the first connecting piece and the second connecting piece 112 are connected, a second groove 114 is formed between the second end part and the connected first connecting piece and second connecting piece 112. At this time, a cup, in which two ends of the handle are connected to the cup wall, can also be accommodated. When the cup is located in the cup sleeve, one end of the handle is extended out from the first groove 113, the other end of the handle is extended out from the second groove 114, and the first connecting piece and the second connecting piece 112 are located between the two ends of the handle, so that the cup, in which the two ends of the handle are connected to the cup wall, can be appropriately accommodated, and the applicability of the cup sleeve can be further improved.

The first connecting piece is set as a hoop surface of a hook-and-hoop fastener, and the second connecting piece 112 is set as a hook surface of the hook-and-hoop fastener, so that the hook-and-hoop fastener is more convenient to connect.

In other embodiments, the first connecting piece and the second connecting piece may also be set as a snap fastener, one is a female fastener and the other is a male fastener. The snap fastener is more convenient to disassemble.

The side wall of the cylindrical cover 11 is further provided with two connecting rings 12. The cup sleeve with high applicability further includes a strap 13. Two ends of the strap 13 are respectively connected to the two connecting rings 12, which is convenient for a user to carry around when going outside and is convenient to use.

In this embodiment, a shoulder pad 131 is arranged on the strap 13, so that the pressure on shoulders can be relieved, and the use sense of the user can be improved. The shoulder pad 131 is provided with a connecting groove 132, and the strap 13 passes through the connecting groove 132, thereby facilitating the connection between the shoulder pad 131 and the strap 13.

The strap 13 is further provided with an adjusting buckle 134 for adjusting the length of the strap, which is convenient for the user to use.

The side wall of the cylindrical cover 11 is provided with two first fastening tapes 115, the two first fastening tapes 115 are respectively connected to two connecting rings 12, the two connecting rings 12 are D-shaped, and straight sides of the connecting rings 12 facilitate the connection with the first fastening tapes 115.

First latch fasteners 133 are arranged at two ends of the strap 13, and the two first latch fasteners 133 are respectively connected to the two connecting rings 12, thereby facilitating the connection between the strap 13 and the cylindrical cover 11.

In this embodiment, the two latch fasteners 133 are both hook buckles, and the two latch fasteners 133 are respectively fixedly connected to the two ends of the strap 13 and are detachably connected to the two connecting rings 12, thereby facilitating the disassembling of the strap 13 and the use of the user.

Second latch fasteners (not shown in the figure) are connected between the first latch fasteners 133 and the connecting rings 12. Due to the design of double latch fasteners, the strap 13 can be assembled and disassembled conveniently, and the latch fasteners can be replaced conveniently when damaged.

The side wall of the cylindrical cover 11 is further provided with a lobster clasp 14, and the lobster clasp 14 is used to be connected to a knapsack or other belongings, which is easier and more labor-saving for the user to use and is convenient to use.

The side wall of the cylindrical cover is further provided with a first pocket 15 for storing articles. The first pocket 15 and the notch 111 are arranged oppositely. When the handle is extended out from the notch 111, the first pocket 15 is prevented from being shielded by the handle, and the articles in the first pocket 15 are taken and put conveniently. A first zipper 151 is arranged at an opening of the first pocket 15. After the first zipper 151 is tightened, the articles in the first pocket 15 can be prevented from falling out.

In this embodiment, the opening of the first pocket 15 is arranged along the edge thereof, so that the opening of the first pocket 15 can be set larger to facilitate the taking and placing of articles.

Two first zippers 151 are provided. The two first zippers 151 can be used alternately, thereby enhancing the durability and having double insurance.

A second pocket 16 is arranged on the surface of the first pocket 15, thereby saving space. Due to the design of double pockets, articles can be classified and stored conveniently. A second zipper 161 is arranged at an opening of the second pocket 16, so that the articles can be prevented from falling out.

In this embodiment, the opening of the second pocket 16 is arranged along the circumferential direction of the cylindrical cover 11, so that the trajectory of the second zipper 161 is prevented from overlapping with the trajectory of the first zipper 151, and the first zippers 151 and the second zipper 161 can be pulled at the same time, thereby facilitating the use of the user.

In this embodiment, a second fastening tape 141 is arranged at the second zipper 161, and the lobster clasp 14 is a hook buckle and is connected to the second fastening tape 141, thereby facilitating the connection between the lobster clasp 14 and the cylindrical cover 11.

Although the present disclosure has been disclosed with preferred embodiments, the preferred embodiments shall not be construed as a limitation to the present disclosure. Those of ordinary skill in the art can make changes and variations without departing from the spirit and scope of the present disclosure. Therefore, the protection scope of the present disclosure shall be subject to the scope defined by the claims.

What is claimed is:

1. A cup sleeve with high applicability, comprising a cylindrical cover having an opening at one end, wherein a side wall of the cylindrical cover is provided with a notch, a first connecting piece and a second connecting piece are respectively arranged on two sides of the notch, the side wall at one side of the notch extends towards the first connecting piece to form the second connecting piece, the second connecting piece and the side wall are formed as an one-piece structure, one end of the second connecting piece facing the first connecting piece is detachably connected to the first connecting piece, and the notch is capable of being partially exposed when the first connecting piece and the second connecting piece are connected;

wherein the cylindrical cover comprises a cylindrical segment and a tapered segment, the notch is substantially arranged in the cylindrical segment, and the tapered segment has an endless wall.

2. The cup sleeve with high applicability according to claim 1, wherein two ends of the notch are respectively a first end part and a second end part, the first end part is close to the opening of the cylindrical cover relative to the second end part, the first end part extends to the opening of the cylindrical cover, and a first groove is formed between the first end part and the connected first connecting piece and second connecting piece when the first connecting piece and the second connecting piece are connected.

3. The cup sleeve with high applicability according to claim 2, wherein a second groove is formed between the second end part and the connected first connecting piece and second connecting piece when the first connecting piece and the second connecting piece are connected.

4. The cup sleeve with high applicability according to claim 1, wherein the first connecting piece is set as a hoop surface of a hook-and-hoop fastener, and the second connecting piece is set as a hook surface of the hook-and-hoop fastener.

5. The cup sleeve with high applicability according to claim 1, wherein the side wall of the cylindrical cover is further provided with two connecting rings, the cup sleeve with high applicability further comprises a strap, and two ends of the strap are respectively connected to the two connecting rings.

6. The cup sleeve with high applicability according to claim 5, wherein first latch fasteners are arranged at two ends of the strap, and the two first latch fasteners are respectively connected to the two connecting rings.

7. The cup sleeve with high applicability according to claim 1, wherein the side wall of the cylindrical cover is further provided with a lobster clasp, and the lobster clasp is configured to be connected to a knapsack or other belongings.

8. The cup sleeve with high applicability according to claim 1, wherein the side wall of the cylindrical cover is further provided with a first pocket, the first pocket and the notch are arranged oppositely, and a first zipper is arranged at an opening of the first pocket.

9. The cup sleeve with high applicability according to claim 8, wherein a second pocket is arranged on a surface of the first pocket, and a second zipper is arranged at an opening of the second pocket.

10. The cup sleeve with high applicability according to claim 1, wherein the notch is a U-shaped notch.

11. The cup sleeve with high applicability according to claim 1, wherein the notch is configured to be passed through by a handle of a cup.

* * * * *